US010495023B2

(12) United States Patent
Wang et al.

(10) Patent No.: US 10,495,023 B2
(45) Date of Patent: Dec. 3, 2019

(54) ENGINE CYLINDER BLOCK

(71) Applicant: XUZHOU XIAN BO ENGINE MACHINERY TECHNOLOGY CO., LTD., Xuzhou (CN)

(72) Inventors: Pengbo Wang, Xuzhou (CN); Ping Wang, Nanjing (CN); Yinping Liu, Dongying (CN)

(73) Assignee: XUZHOU XIAN BO ENGINE MACHINERY TECHNOLOGY CO., LTD., Xuzhou (CN)

( * ) Notice: Subject to any disclaimer, the term of this patent is extended or adjusted under 35 U.S.C. 154(b) by 0 days.

(21) Appl. No.: 16/309,932

(22) PCT Filed: Jun. 16, 2017

(86) PCT No.: PCT/CN2017/088811
§ 371 (c)(1),
(2) Date: Dec. 14, 2018

(87) PCT Pub. No.: WO2017/215666
PCT Pub. Date: Dec. 21, 2017

(65) Prior Publication Data

US 2019/0145346 A1 May 16, 2019

(30) Foreign Application Priority Data

Jun. 16, 2016 (CN) ..... 2016 1 0431638

(51) Int. Cl.
*F02F 7/00* (2006.01)
*F02B 75/06* (2006.01)
(Continued)

(52) U.S. Cl.
CPC ..... *F02F 7/0043* (2013.01); *F02B 75/065* (2013.01); *F02F 1/14* (2013.01);
(Continued)

(58) Field of Classification Search
CPC ..... F02F 7/0043; F02F 1/20; F02F 7/0007; F02F 7/007; F02F 1/14; F02F 7/0053;
(Continued)

(56) References Cited

U.S. PATENT DOCUMENTS 4,690,113 A 9/1987 Deland
5,595,147 A * 1/1997 Feuling ..... F02B 75/065 123/197.1
(Continued)

FOREIGN PATENT DOCUMENTS

CN 1077248 A 10/1993
CN 2504392 Y 8/2002
(Continued)

*Primary Examiner* — Jacob M Amick
(74) *Attorney, Agent, or Firm* — Gokalp Bayramoglu

(57) ABSTRACT

An engine cylinder block includes a cylinder block housing and a double-crankshaft mechanism installation case located at a downside of the cylinder block housing. The cylinder block housing is integrally connected with the double-crankshaft mechanism installation case. The cylinder block housing is provided with a cylinder block cavity. The double-crankshaft mechanism installation case is enclosed and formed by an end cover and a side cover. A piston rod guiding groove is installed in the double-crankshaft mechanism installation case. A connecting rod sliding groove is configured through the piston rod guiding groove. A crank operation cavity is configured on both sides of the piston rod guiding groove. A main spindle installation hole is configured on the shell at both ends of each crank operation cavity. A main spindle supporting portion is configured below the main spindle installation hole.

9 Claims, 9 Drawing Sheets

(51) Int. Cl.
*F02F 1/14* (2006.01)
*F02F 1/20* (2006.01)
*F02B 75/22* (2006.01)

(52) U.S. Cl.
CPC ..... *F02F 1/20* (2013.01); *F02F 7/0007* (2013.01); *F02F 7/007* (2013.01); *F02B 75/225* (2013.01)

(58) Field of Classification Search
CPC ..... F04C 2/07; F04C 18/07; F02B 75/065; F02B 75/225
See application file for complete search history.

(56) References Cited

U.S. PATENT DOCUMENTS 5,680,840 A * 10/1997 Mandella ..... F02B 75/04 123/197.4
5,836,273 A * 11/1998 Hair ..... F01B 9/02 123/52.4
2014/0041622 A1 2/2014 Yoshizawa et al.

FOREIGN PATENT DOCUMENTS

| | | | |
|---|---|---|---|
| CN | 101503966 | A | 8/2009 |
| CN | 102536455 | A | 7/2012 |
| CN | 104481689 | A | 4/2015 |
| CN | 105909417 | A | 8/2016 |
| CN | 105927380 | A | 9/2016 |
| CN | 205744144 | U | 11/2016 |
| CN | 205876526 | U | 1/2017 |

* cited by examiner

ENGINE CYLINDER BLOCK

CROSS REFERENCE TO RELATED APPLICATIONS

This application is the national phase entry of International Application No. PCT/CN2017/088811, filed on Jun. 16, 2017, which is based upon and claims priority to Chinese Patent Application No. 201610431638.X filed on Jun. 16, 2016, the entire contents of which are incorporated herein by reference.

TECHNICAL FIELD

The present invention relates to an engine cylinder block and pertains to the technical field of engines.

BACKGROUND

At present, in both gasoline engines and diesel engines, the actual thermal efficiency is much lower than the theoretical thermal efficiency. One of the primary causes for this phenomenon is that the components directly contacted with high-temperature gas, such as cylinder liners, pistons, etc., are made of metal material with poor thermal insulation performance. The continuous and reliable work of metal material depends on that the cooling system continuously cools the heat absorbed from the airtight combustor. Ceramic material is a material with good thermal insulation performance. The components directly contacted with high-temperature gas, such as cylinder liners, pistons, etc., are made of ceramic material, which can improve the actual thermal efficiency. However, the low reliability due to the brittleness of ceramic material becomes a technical obstacle to apply the ceramic material to the engine.

The patent (Application No. CN201410653964.6) filed by the present inventors proposes a double-crank drive mechanism composed of a double-crankshaft device to solve the above-mentioned problems, but a specific structure of a cylinder block has not been disclosed.

SUMMARY

In order to overcome the above-mentioned deficiencies of the prior art, the present invention provides an engine cylinder block that provides a specific structure of the cylinder for a double-crank drive mechanism composed of double-crankshaft devices.

The present invention is achieved by the following technical solution: an engine cylinder block includes a cylinder block housing and a double-crankshaft mechanism installation case located at a bottom of the cylinder block housing. The cylinder block is integrally connected with the double-crankshaft mechanism installation case.

A cylinder cavity hermetically contacted with a piston head to form a combustor is provided in the cylinder block housing.

The double-crankshaft mechanism installation case is enclosed and formed by an end cover and a side cover, and has a lower opening. Inside the double-crankshaft mechanism installation case, under the position corresponding to the position of the cylinder cavity, a piston rod guiding groove matched with a guiding rod of a piston are provided. The piston rod guiding groove is provided with a connecting rod sliding groove for the up-down motion of the connecting rod. Two sides of the piston rod guiding groove are provided with a crank operation cavity for the circular rotation of the crank of the crankshaft around the main spindle. The double-crankshaft mechanism installation case is provided with a main spindle installation hole for inserting a crankshaft main spindle at two ends of each crank operation cavity. A main spindle support is configured below the main spindle installation hole;

A central output gear mandrel is installed on one end of the double-crankshaft mechanism installation case. The installation position of the central output gear mandrel is required at a position where the central output gear simultaneously engages with the drive gears at the ends of double-crankshaft.

The piston rod guiding groove is a cylindrical groove. The connecting rod sliding groove is a rectangular groove.

The main spindle support is a main spindle semicircular cover. The main spindle installation hole is a semi-circular hole. The main spindle semicircular cover is provided with an abutting semi-circular hole. The main spindle semicircular cover is fastened to the main spindle installation hole by fasteners. The abutting semi-circular hole and the main spindle installation hole form a main spindle circular hole.

End caps of two end of the double-crankshaft mechanism installation case and an underside of each main spindle installation hole in the double-crankshaft mechanism installation case are respectively provided with a main spindle semicircular cover installation groove. A sealing plate is formed between the main spindle semicircular cover installation grooves. The main spindle semicircular cover is installed on the main spindle semicircular cover installation groove.

A water channel port is installed on a side of the cylinder block housing. The water channel port has both a water outlet port and a water inlet port.

An upper end of the cylinder block housing and a lower end of the double-crankshaft mechanism installation case are provided with fastener installation interfaces used to connect to other components of an engine housing.

A drive gear cap matched with the drive gear is installed on both sides of the center output gear mandrel on the double-crankshaft mechanism installation case.

The cylinder block housing or the double-crankshaft mechanism installation case is provided with water channel ports connected to a cooling water supply. Cooling water channels connected with the water channel ports are configured around side walls of the cylinder cavity.

The cylinder block housing or the double-crankshaft mechanism installation case is provided with an oil channel port. Lubricating oil channels used to lubricate the crankshaft and each kinematic pair of a piston guider are configured on an inner wall of the cylinder block housing and an inner wall of the double-crankshaft mechanism installation case. Each lubricating oil channel is connected with the oil channel port.

Advantage of the present invention: the present invention provides a specific cylinder structure for the double-crank drive mechanism composed of the double-crankshaft device, which realizes the separation between the sealing end and the guiding end of the piston, makes all the motion surfaces at a condition of low-temperature and easily lubricated, has a compact structure and a good manufacturability, and meets the requirements of the engine actual operation.

BRIEF DESCRIPTION OF THE DRAWINGS

The present invention will be further described hereinafter with reference to the drawings.

In the drawings.

1: cylinder block housing,
2: double-crankshaft mechanism installation case,
2-1: end cover,
2-2: side cover,
2-3: sealing plate,
2-4: main spindle semicircular cover installation groove,
3: cylinder cavity,
4: crank operation cavity,
5: main spindle installation hole,
6: piston rod guiding groove,
7: connecting rod sliding groove,
8: fastener installation interface,
9: central output gear mandrel,
10: water channel port,
10-1: water outlet port,
10-2: water inlet port,
11: cooling water channel,
12: lubricating oil channel,
13: drive gear cap,
14: central gear output end,
15: main spindle semicircular cover,
15-1: abutting semi-circular hole,
16: oil channel port, and
17: oil pan.
18: main spindle circular hole

DETAILED DESCRIPTION OF THE EMBODIMENTS

The present invention will be further described hereinafter with the embodiments.

Figure 1:
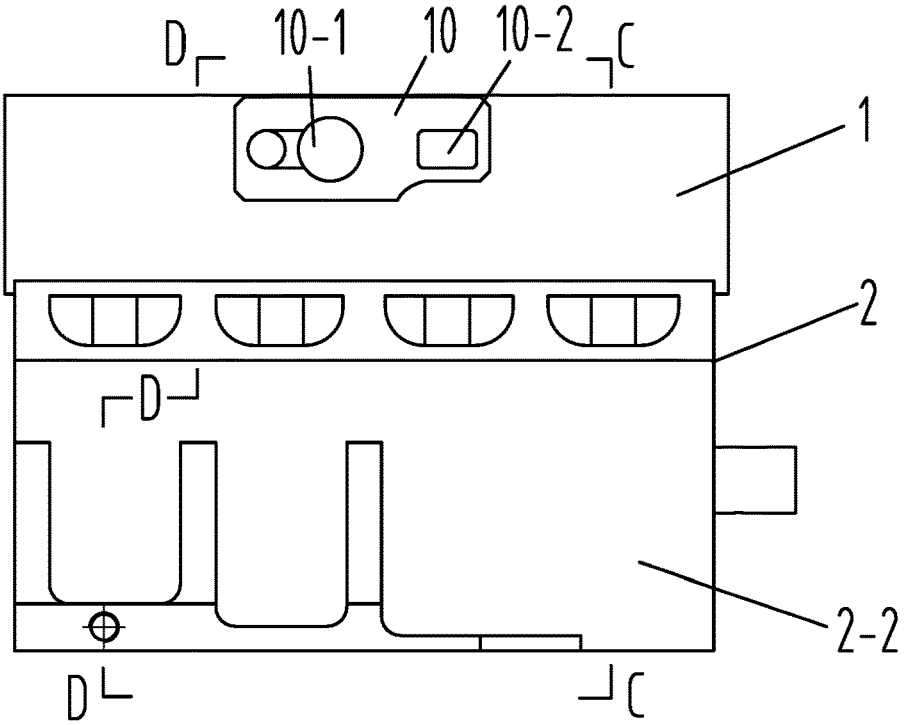
FIG. 1 is a front view of the present invention.
Figure 2:
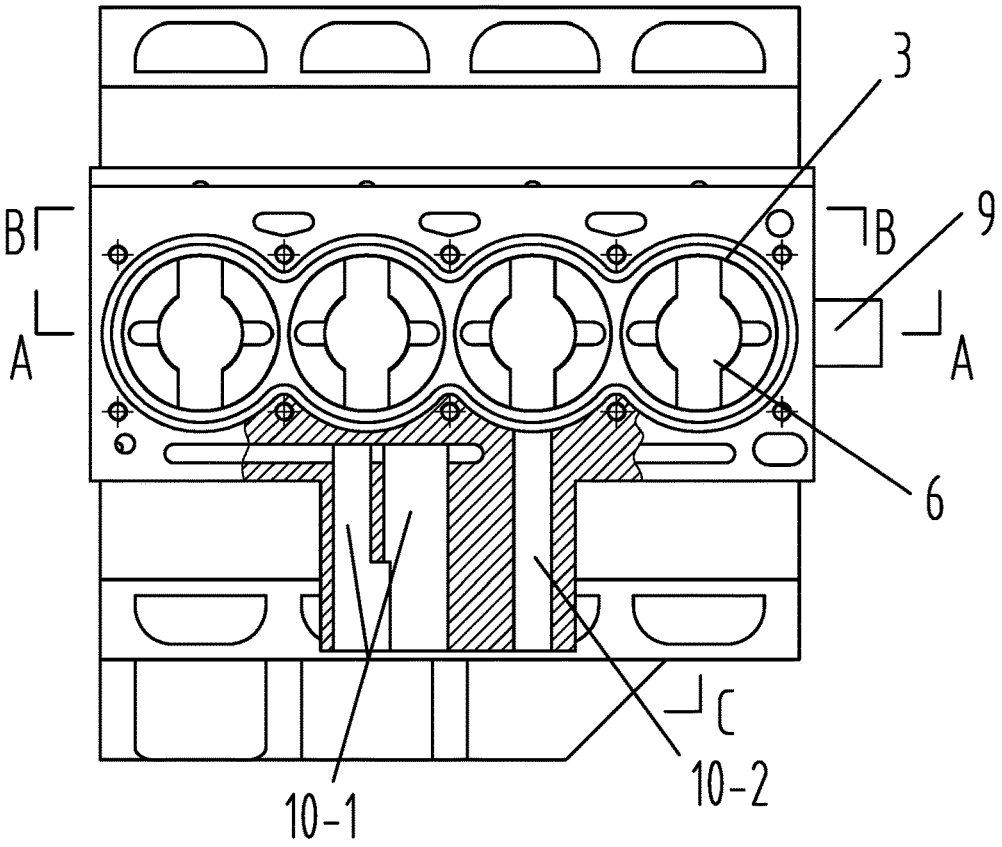
FIG. 2 is a top view showing the section of the water channel port of the present invention.
Figure 3:
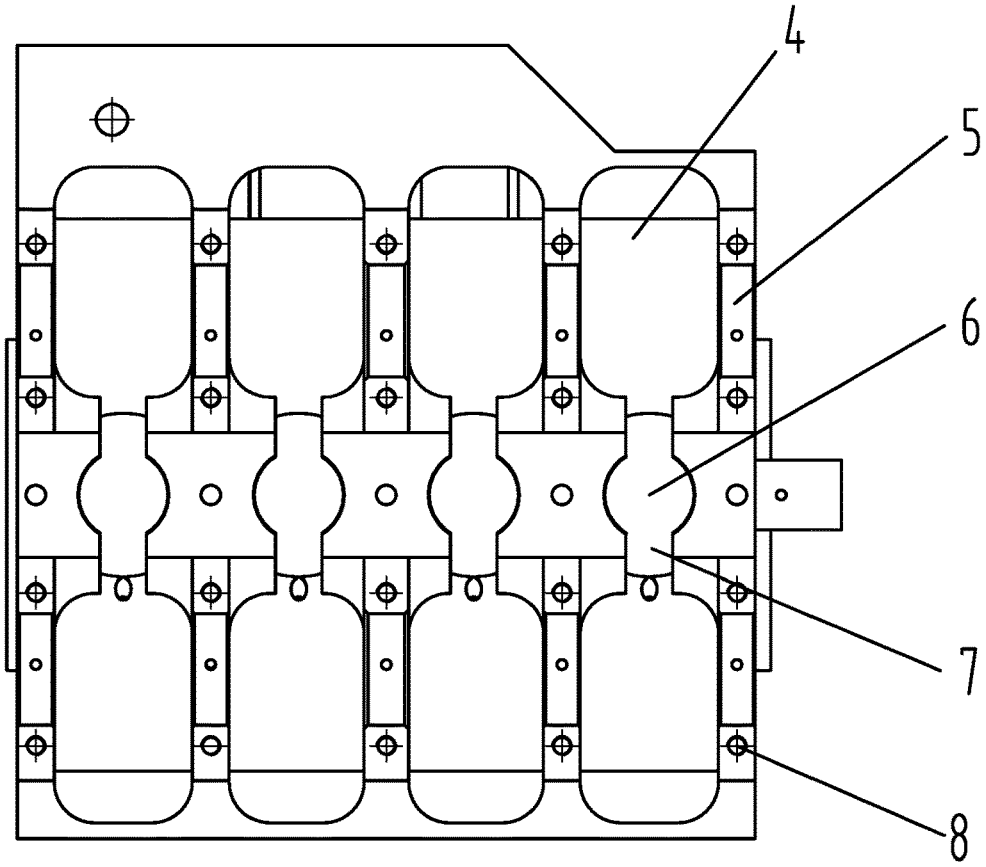
FIG. 3 is a bottom view of the present invention.
Figure 4:
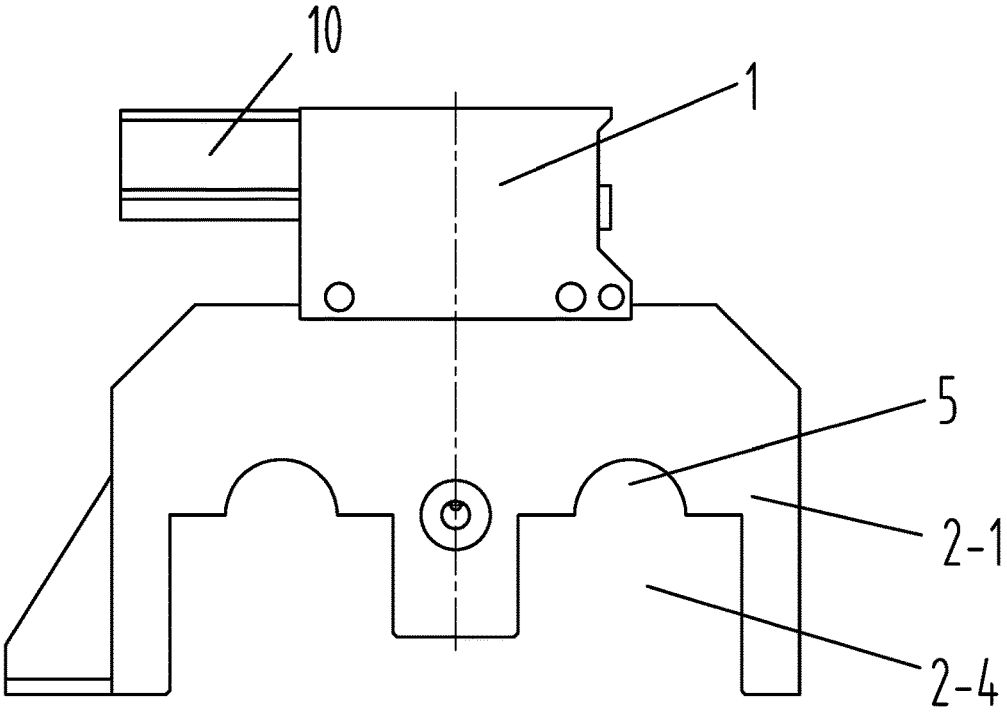
FIG. 4 is a right side view of the present invention.
Figure 5:
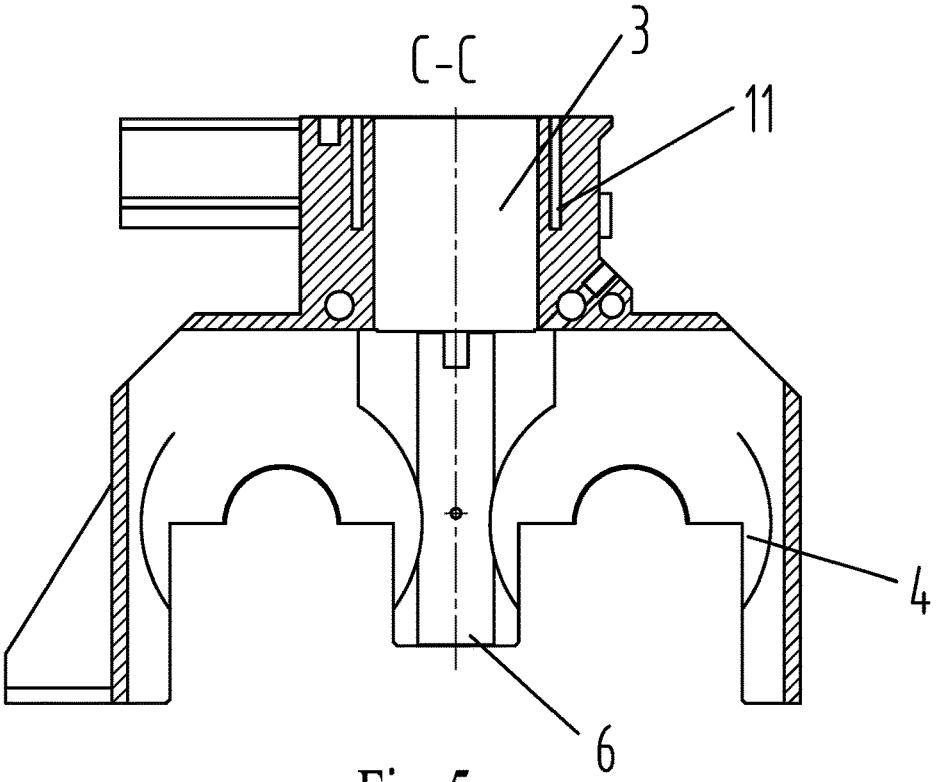
FIG. 5 is a sectional view along the line C-C of FIG. 1.
Figure 6:
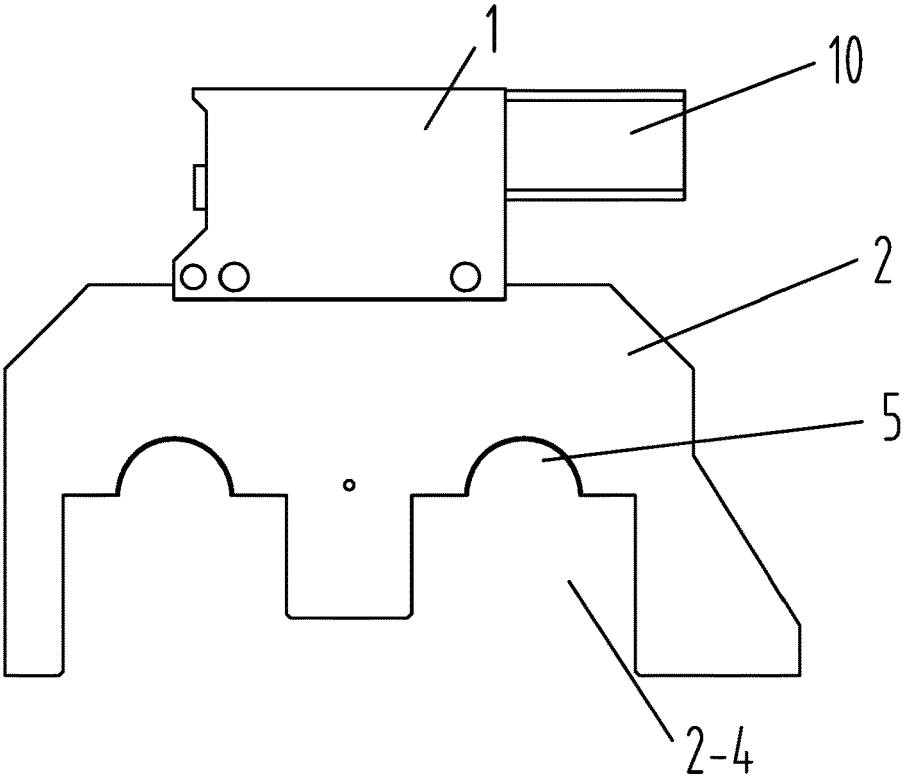
FIG. 6 is a left side view showing of the present invention.
Figure 7:
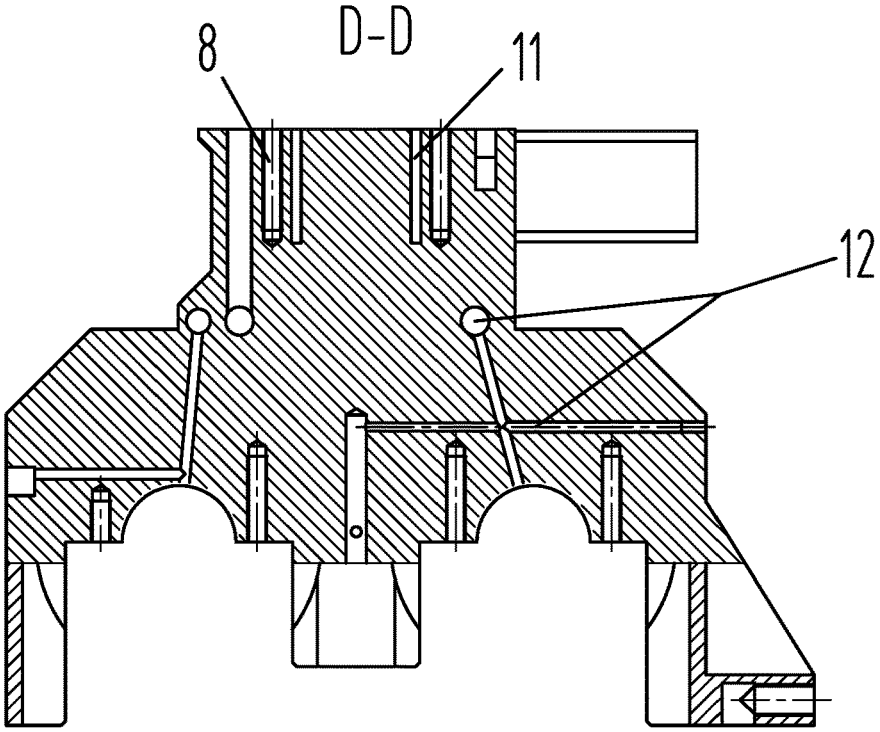
FIG. 7 is a sectional view along the line D-D of FIG. 1.
Figure 8:
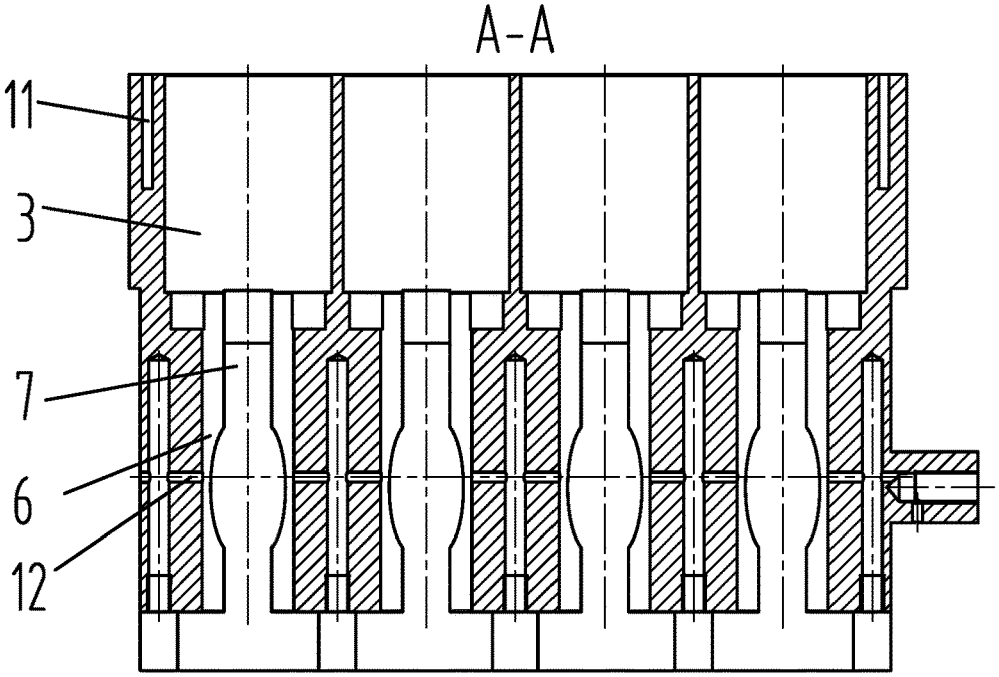
FIG. 8 is a sectional view along the line A-A of FIG. 2.
Figure 9:
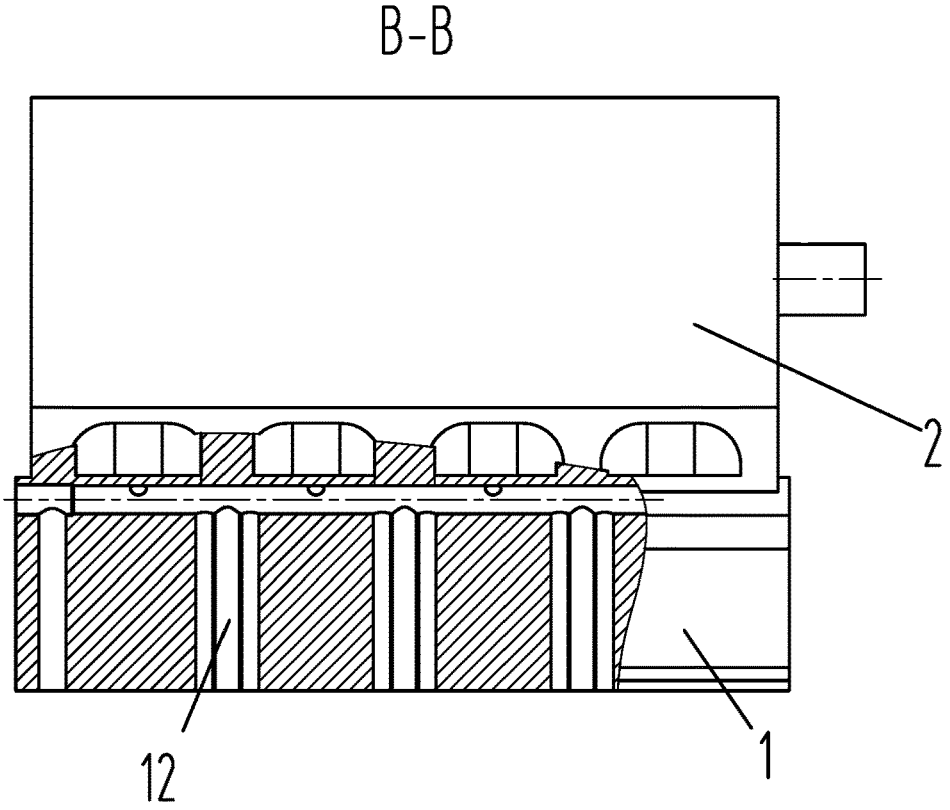
FIG. 9 is a partial sectional view along the line B-B of FIG. 2.
Figure 10:
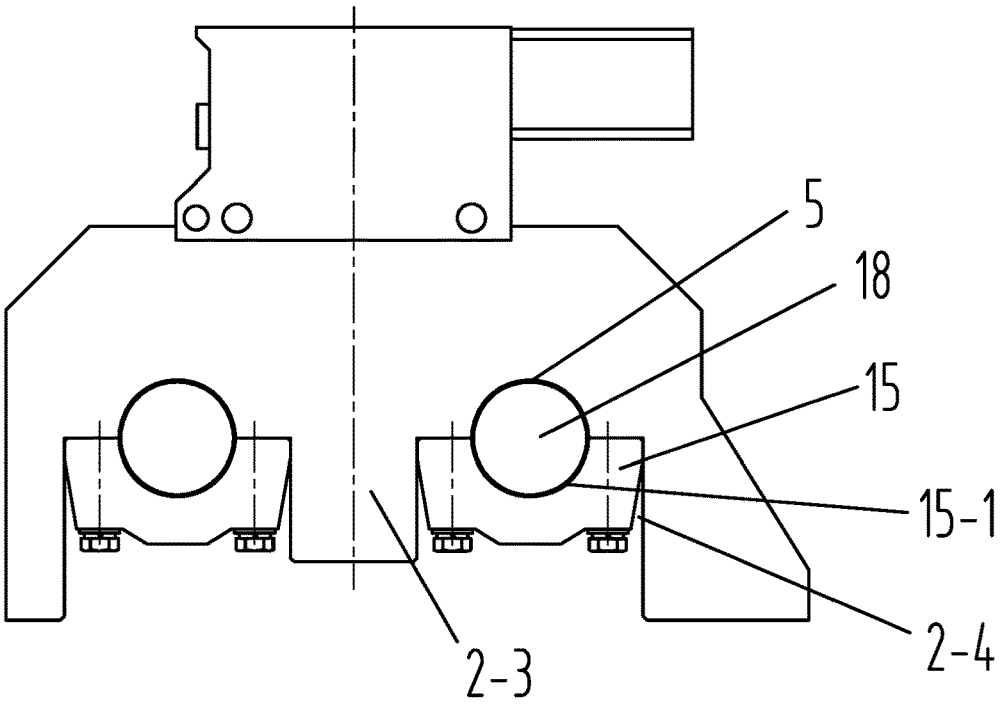
FIG. 10 is a left side view showing the present invention adding a main spindle semicircular cover.
Figure 11:
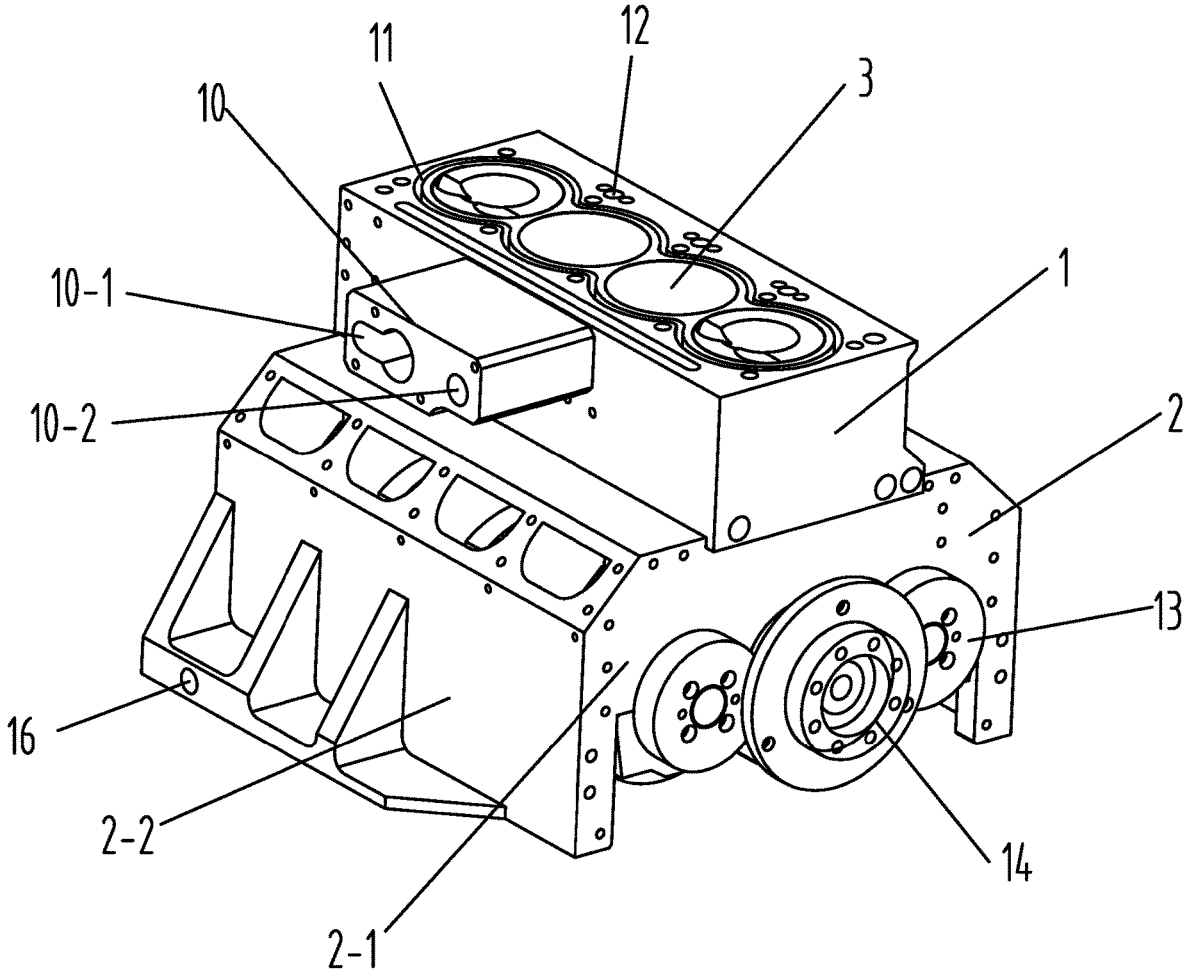
FIG. 11 is a perspective view showing the present invention.
Figure 12:
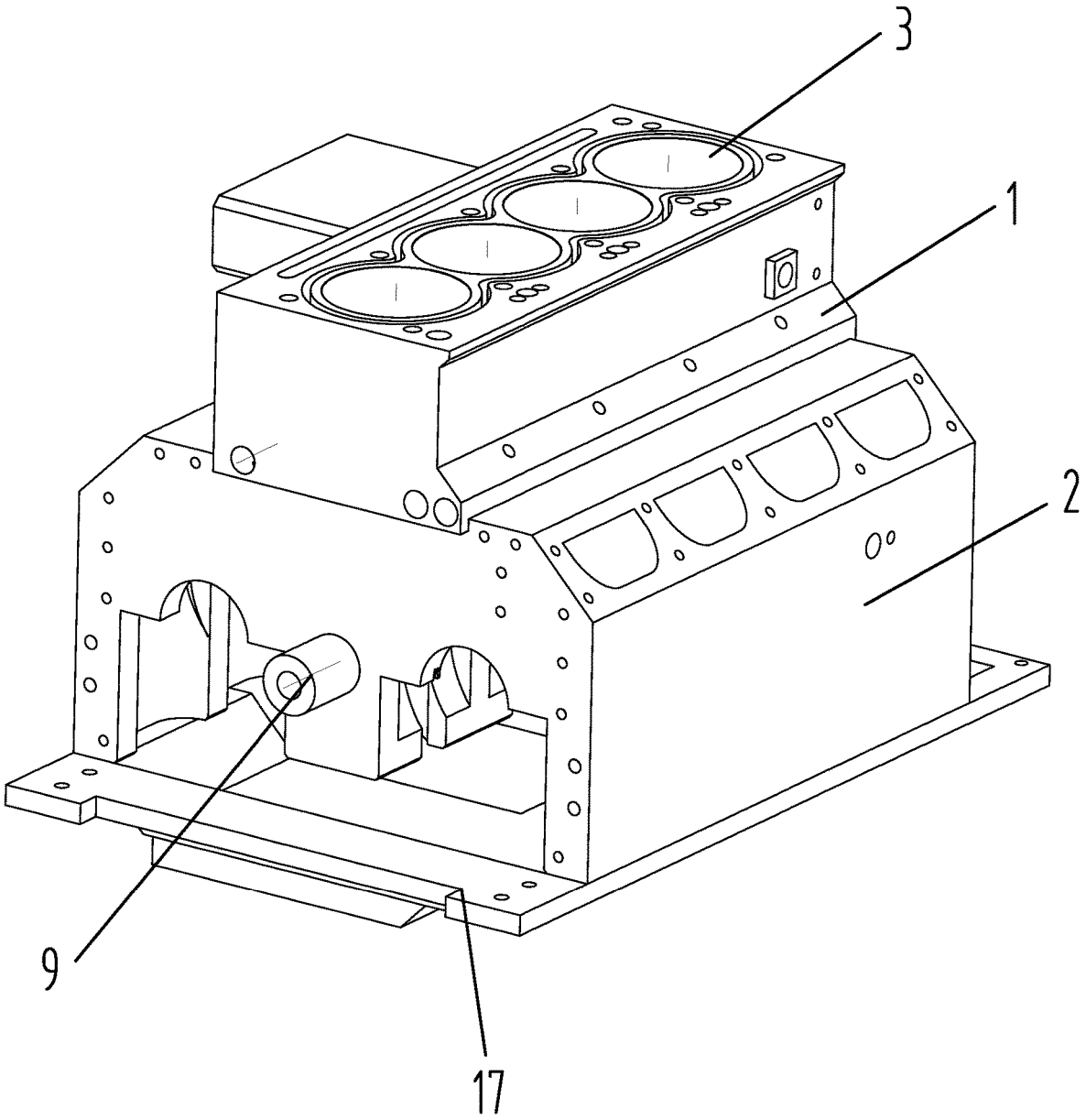
FIG. 12 and FIG. 13 are two perspective views showing the present invention adding an oil pan.
Figure 13:
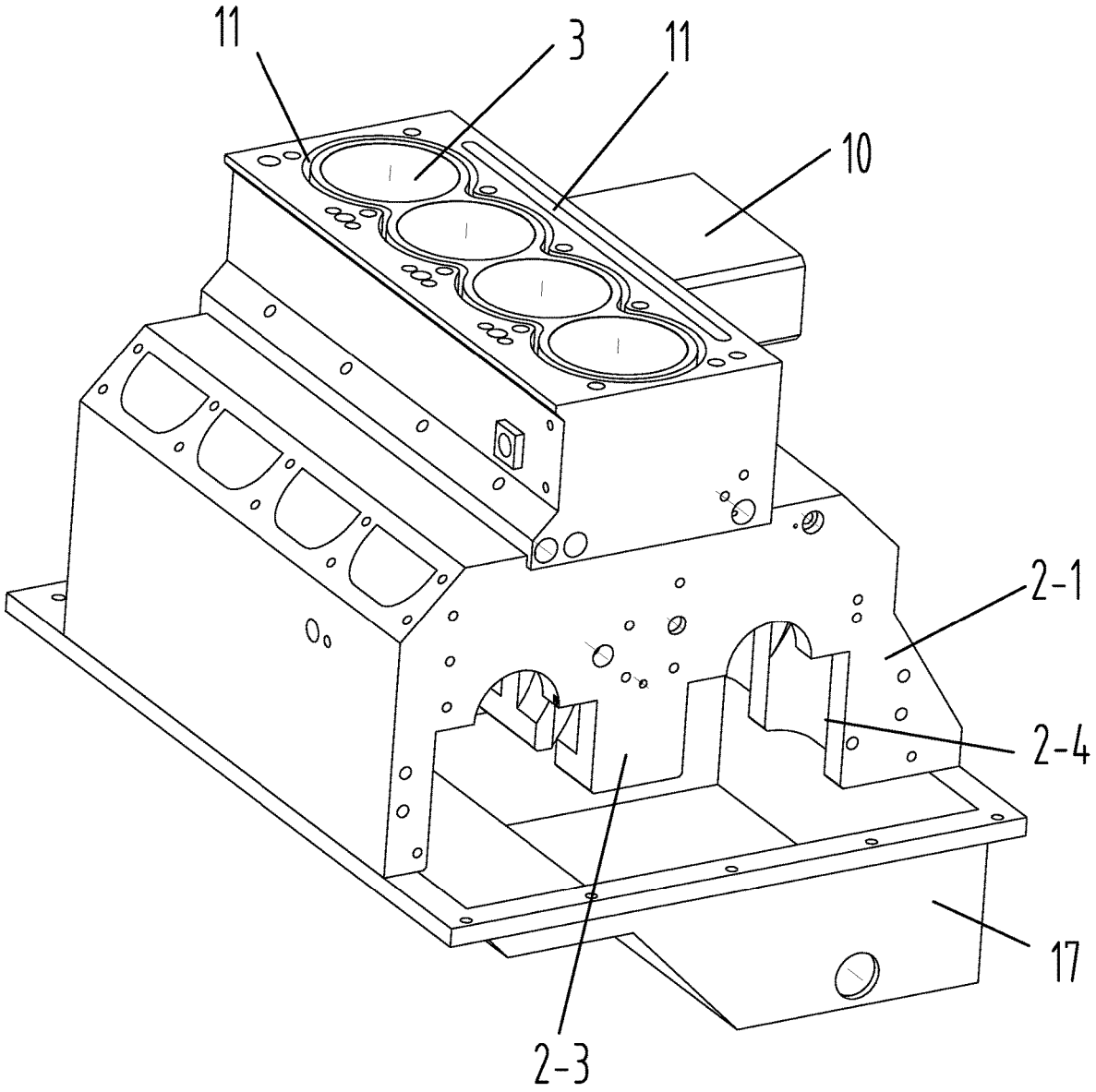
Figure 14:
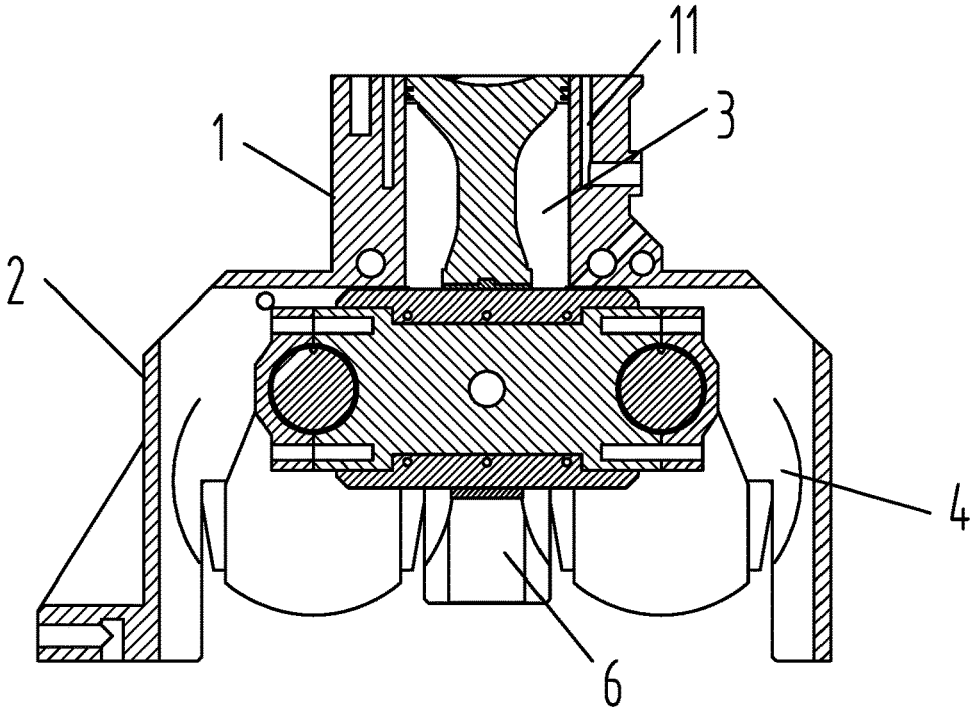
FIG. 14 is a structure schematic view showing the piston movement and connection structure of the present invention.
Figure 15:
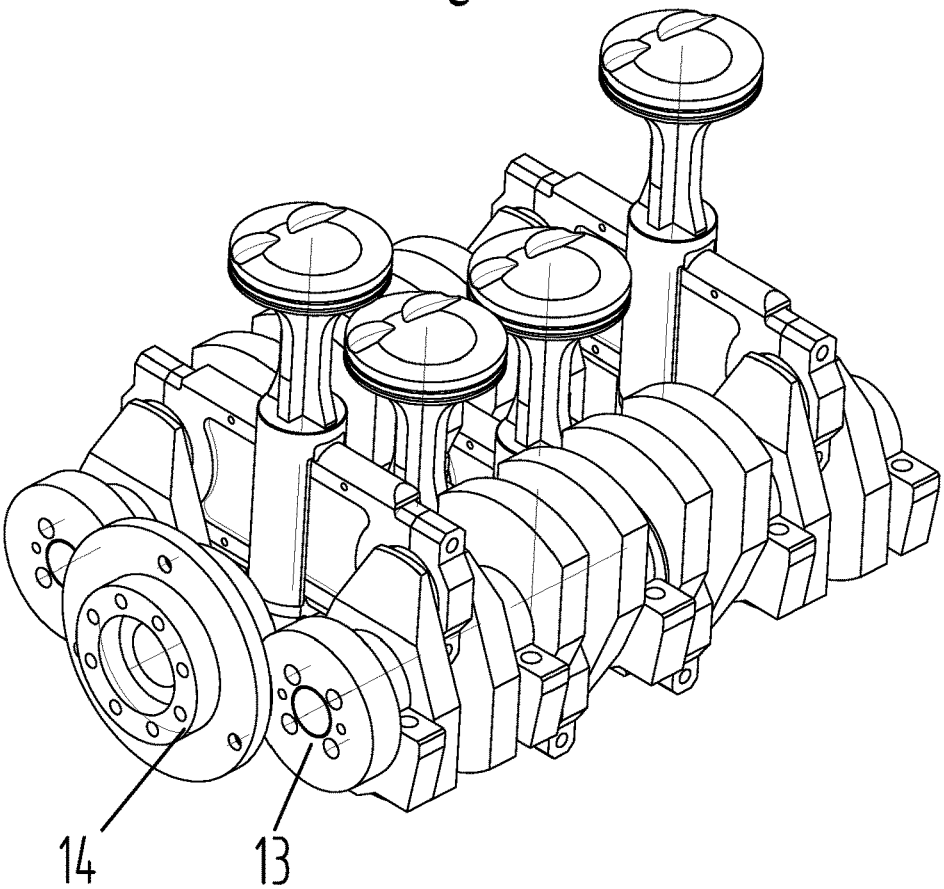
FIG. 15 is a structural schematic view showing a double-crank drive mechanism installed in the present invention.

As shown in FIGS. 1-15, the present invention is achieved by the following technical solution: an engine cylinder block includes cylinder block housing 1 and double-crankshaft mechanism installation case 2 located at a bottom of the cylinder block housing 1. The cylinder block housing 1 is integrally connected with the double-crankshaft mechanism installation case 2 to form an entirety.

A cylinder cavity 3 hermetically contacted with a piston head to form a combustor is provided in the cylinder block housing 1.

The double-crankshaft mechanism installation case 2 is enclosed and formed by end cover 2-1 and side cover 2-2, and has a lower opening. Inside the double-crankshaft mechanism installation case 2, underside of the position corresponding to the position of the cylinder block cavity 3, is provided with a piston rod guiding groove 6 matched with a guiding rod of a piston. The piston rod guiding groove 6 is provided with connecting rod sliding groove 7 for the up-down motion of the connecting rod. Two sides of the piston rod guiding groove 6 are provided with crank operation cavity 4 for the circular rotation of the crank of the crankshaft around the main spindle. The double-crankshaft mechanism installation case 2 is provided with a main spindle installation hole 5 for inserting a crankshaft main spindle at two ends of each crank operation cavity 4. A main spindle support is configured below the main spindle installation hole 5;

Central output gear mandrel 9 is installed on one end of the double-crankshaft mechanism installation case 2. The installation position of the central output gear mandrel 9 is required at a position where the central output gear simultaneously engages with the drive gears of double-crankshaft ends.

The piston rod guiding groove 6 is a cylindrical groove. The connecting rod sliding groove 7 is a rectangular groove.

The main spindle support is main spindle semicircular cover 15. The main spindle installation hole 5 is a semicircular hole. The main spindle semicircular cover 15 is provided with abutting semi-circular hole 15-1. The main spindle semicircular cover 15 is fastened to the main spindle installation hole 5 by fasteners. The abutting semi-circular hole 15-1 and the main spindle installation hole 5 form a main spindle circular hole 18.

End caps of two end of the double-crankshaft mechanism installation case 2 and an underside of each main spindle installation hole 5 in the double-crankshaft mechanism installation case 2 is respectively provided with main spindle semicircular cover installation groove 2-4. A sealing plate 2-3 is formed between the main spindle semicircular cover installation grooves 2-4. The main spindle semicircular cover 15 is installed on the main spindle semicircular cover installation groove 2-4.

Water channel port 10 is installed on a side of the cylinder block housing 1. The water channel port 10 has both water outlet port 10-1 and water inlet port 10-2.

An upper end of the cylinder block housing 1 and a lower end of the double-crankshaft mechanism installation case 2 are provided with fastener installation interfaces 8 used to connect to other components of an engine housing.

Drive gear cap 13 matched with the drive gear is installed on both sides of the center output gear mandrel 9 on the double-crankshaft mechanism installation case 2.

The cylinder block housing 1 or the double-crankshaft mechanism installation case 2 is provided with water channel ports 10 connected to a cooling water supply. Cooling water channels 11 connected with the water channel ports 10 are configured around side walls of the cylinder cavity 3.

The cylinder block housing 1 or the double-crankshaft mechanism installation case 2 is provided with oil channel port 16. Lubricating oil channels 12 used to lubricate the crankshaft and each kinematic pair of a piston guider are configured on an inner wall of the cylinder block housing 1 and an inner wall of the double-crankshaft mechanism installation case 2. Each lubricating oil channel 12 is connected with the oil channel port 16.

The present invention provides a specific cylinder structure for the double-crankshaft drive mechanism composed of the double-crankshaft device, which realizes the separation between the sealing end and the guiding end of the piston, makes all the motion surfaces at a condition of low-temperature and easily lubricated, has a compact structure and a good manufacturability, and meets the requirement of the engine actual operation.

What is claimed is:

1. An engine cylinder block, comprising a cylinder block housing and a double-crankshaft mechanism installation case located at a downside of the cylinder block housing; wherein the cylinder block housing is integrally connected with the double-crankshaft mechanism installation case to form an entirety;

a cylinder block cavity hermetically contacted with a piston head to form a combustor is provided in the cylinder block housing;

the double-crankshaft mechanism installation case is enclosed and formed by an end cover and a side cover, and has a lower opening; a piston rod guiding groove matched with a guiding rod of a piston is provided below a position inside the double-crankshaft mechanism installation case, and the position corresponds to a position of the cylinder block cavity; the piston rod guiding groove is provided with a connecting rod sliding groove for an up-down motion of the connecting rod; two sides of the piston rod guiding groove are respectively provided with a crank operation cavity for the circular rotation of a crank of a crankshaft around a main spindle; the double-crankshaft mechanism installation case (2) is provided with a main spindle installation hole for the main spindle at two ends of each crank operation cavity; a main spindle support is configured below the main spindle installation hole;

a central output gear mandrel is installed on one end of the double-crankshaft mechanism installation case; and an installation position of the central output gear mandrel is required at a position where the central output gear simultaneously engages with drive gears on the ends of double-crankshaft.

2. The engine cylinder block according to claim 1, wherein the piston rod guiding groove is a cylindrical through groove; and the connecting rod sliding groove is a rectangular through groove.

3. The engine cylinder block according to claim 1, wherein the main spindle support is a main spindle semicircular cover; the main spindle installation hole is a semicircular hole; the main spindle semicircular cover is provided with an abutting semi-circular hole; the main spindle semicircular cover is fastened to the main spindle installation hole by fasteners; and the abutting semi-circular hole and the main spindle installation hole form a main spindle circular hole.

4. The engine cylinder block according to claim 3, wherein end caps of two end of the double-crankshaft mechanism installation case and an underside of each main spindle installation hole in the double-crankshaft mechanism installation case are respectively provided with main spindle semicircular cover installation groove; a sealing plate is formed between two of the main spindle semicircular cover installation grooves; and the main spindle semicircular cover is installed on the main spindle semicircular cover installation groove.

5. The engine cylinder block according to claim 1, wherein an upper end of the cylinder block housing and a lower end of the double-crankshaft mechanism installation case are provided with fastener installation interfaces configured to connect to other components of an engine housing.

6. The engine cylinder block according to claim 1, wherein a drive gear cap matched with the drive gear is respectively installed on both sides of the central output gear mandrel on the double-crankshaft mechanism installation case.

7. The engine cylinder block according to claim 1, wherein the cylinder block housing or the double-crankshaft mechanism installation case is provided with a water channel ports connected to a cooling water supply; and cooling water channels connected with the water channel ports are configured around side walls of the cylinder block cavity.

8. The engine cylinder block according to claim 1, wherein the cylinder block housing or the double-crankshaft mechanism installation case is provided with an oil channel port; lubricating oil channels configured to lubricate the crankshaft and each kinematic pair of a piston guider are configured on an inner wall of the cylinder block case and an inner wall the double-crankshaft mechanism installation case; and the lubricating oil channel is connected with the oil channel port.

9. The engine cylinder block according to claim 7, wherein the water channel port is installed on a side of the cylinder block housing; and the water channel port has a water outlet port and a water inlet port.

* * * * *